US006716063B1

(12) United States Patent
Bryant et al.

(10) Patent No.: US 6,716,063 B1
(45) Date of Patent: Apr. 6, 2004

(54) ELECTRICAL CABLE INSERT

(75) Inventors: Michael John Bryant, Houston, TX (US); Nick C. George, Sugarland, TX (US)

(73) Assignee: PGS Exploration (US), Inc., Houston, TX (US)

( * ) Notice: Subject to any disclaimer, the term of this patent is extended or adjusted under 35 U.S.C. 154(b) by 0 days.

(21) Appl. No.: 09/514,423

(22) Filed: Feb. 28, 2000

(Under 37 CFR 1.47)

(51) Int. Cl.[7] ..... H01R 13/40
(52) U.S. Cl. ..... 439/589
(58) Field of Search ..... 439/274, 275, 439/587, 660, 662, 686, 701, 589, 598, 879, 891

(56) References Cited

U.S. PATENT DOCUMENTS

| | | | | |
|---|---|---|---|---|
| 2,590,531 A | | 3/1952 | McLoad | |
| 2,605,315 A | | 7/1952 | Hargett | |
| 2,655,638 A | * | 10/1953 | Allen | 439/271 |
| 2,825,039 A | | 2/1958 | Shurman et al. | |
| 2,923,916 A | | 2/1960 | Woodworth | |
| 3,040,287 A | | 6/1962 | Agron et al. | |
| 3,181,105 A | | 4/1965 | Roach et al. | |
| 3,221,292 A | * | 11/1965 | Swanson et al. | 439/589 |
| 3,281,558 A | * | 10/1966 | Weber | 337/188 |
| 3,562,406 A | | 2/1971 | Uhlig et al. | |
| 3,643,208 A | | 2/1972 | Massa, Jr. | |
| 3,812,455 A | | 5/1974 | Pearson | |
| 3,854,789 A | | 12/1974 | Kaplan | |
| 3,924,916 A | | 12/1975 | Venaleck | |
| 3,956,575 A | | 5/1976 | Sutherland | |
| 3,997,232 A | | 12/1976 | Dunaway | |
| 4,025,827 A | | 5/1977 | Pellerin et al. | |
| 4,084,625 A | | 4/1978 | Brinegar | |
| 4,084,875 A | * | 4/1978 | Yamamoto | 439/274 |
| 4,204,188 A | | 5/1980 | Weichart et al. | |
| 4,317,185 A | | 2/1982 | Thigpen et al. | |
| 4,351,036 A | | 9/1982 | Mollere | |
| 4,447,104 A | | 5/1984 | Haggard | |
| 4,487,467 A | | 12/1984 | Guerrero et al. | |
| 4,503,526 A | | 3/1985 | Beauducel et al. | |
| 4,526,430 A | | 7/1985 | Williams | |

(List continued on next page.)

FOREIGN PATENT DOCUMENTS

| | | |
|---|---|---|
| EP | 0655804 | 5/1995 |
| EP | 0971452 | 1/2000 |
| GB | 2323976 A | 10/1998 |
| WO | WO 9965120 | 12/1999 |

*Primary Examiner*—Tulsidas Patel
*Assistant Examiner*—Thanh-Tam Le
(74) *Attorney, Agent, or Firm*—E. Eugene Thigpen

(57) ABSTRACT

There is provided an electric cable insert for removably electrically connecting a cable having multiple conductors to a mating receptacle wherein the number and configuration of the cable conductors may be different from those of the sockets of the mating receptacle. The insert includes a housing open on one end to an internal cavity and having a plurality of orifices in the other end. The cable conductors connect to one side of a circuit card within the housing which conductively transitions from the number and configuration of the cable conductors to the number and configuration of the sockets of the mating receptacle. Receptacle pins extend from the opposite side of the circuit card through respective orifices in the housing for connecting to respective sockets in the mating receptacle. A compressed sealing gland disposed within the housing adjacent the circuit card provides the insert with an energized compression seal from the environment. A driver closes the end of the housing and maintains compression in the sealing gland. The cable conductors pass through respective bores in the sealing gland and in the driver.

6 Claims, 3 Drawing Sheets

U.S. PATENT DOCUMENTS 4,530,075 A 7/1985 Pearson
4,549,755 A 10/1985 Kot et al.
4,594,698 A 6/1986 Hefer
4,629,269 A * 12/1986 Kailus ..... 439/587
4,734,891 A 3/1988 McGowan et al.
4,758,174 A 7/1988 Michaels et al.
4,796,365 A 1/1989 Hudson
4,811,311 A 3/1989 Woodall, Jr. et al.
4,914,642 A 4/1990 Fraser et al.
5,120,237 A 6/1992 Fussell
5,183,966 A 2/1993 Hurtado et al.
5,199,893 A 4/1993 Fussell
5,274,603 A 12/1993 Zibilich, Jr. et al.
5,274,917 A 1/1994 Corbett, III et al.
5,400,298 A 3/1995 Hepp
5,417,592 A 5/1995 West
5,451,169 A 9/1995 Corbett, III et al.
5,510,577 A 4/1996 Corrigan
5,513,151 A 4/1996 Morningstar et al.
5,580,266 A 12/1996 Shelly
5,605,468 A 2/1997 Wood
5,618,198 A 4/1997 Sato et al.
5,626,493 A * 5/1997 Post et al. ..... 439/555
5,634,807 A * 6/1997 Saito ..... 439/275
5,670,747 A 9/1997 Lawer et al.
5,704,799 A 1/1998 Wood
5,724,315 A 3/1998 Moffett et al.
5,733,135 A 3/1998 Kennedy et al.
5,821,461 A 10/1998 Sackett
5,830,011 A 11/1998 Wood
5,890,930 A * 4/1999 Gerow ..... 439/651

* cited by examiner

SHEET

ELECTRICAL CABLE INSERT

TECHNICAL FIELD OF THE INVENTION

The present invention generally relates to electric cable connectors, and, more particularly, is concerned with an electrical connector insert having an improved seal from the environment and that will mate a standard receptacle to a cable having a different number and configuration of conductors than those of the standard receptacle.

BACKGROUND OF THE INVENTION

In the offshore seismic exploration industry, streamers carrying hydrophone and geophone sensors are towed behind exploration vessels for receiving reflected acoustic signals produced by seismic wave generating sources. The streamers are connected to the vessels by lead-in cables which carry electrical power to the streamers, and seismic data and telemetry from the streamers, to data processing equipment aboard the towing vessel. In ocean bottom seismic exploration, the seismic signals are received by hydrophone and/or geophone sensors connected to cables laid directly on the ocean floor. These ocean bottom cables are also connected to the vessel by lead-in cables.

All of the various streamers and cables are electrically and mechanically connected end-to-end by cable connectors having inserts designed to seal the interconnection from the environment, particularly from ingress by sea water, which results in the loss of electrical integrity. When leakage of water into a connector interface causes an electrical short, the seismic signal shooting and data collection must be stopped and the lengthy cables leading to the shorted connector pulled aboard the vessel so that the failed connector can be repaired or replaced. The exploration shooting down time required to replace a shorted cable connector is significant and very expensive.

In the offshore seismic exploration industry, a widely used, standard cable connector or receptacle insert is the Syntrak 37-pin insert. This Syntrak insert has 37 pins or mating sockets arranged in a fixed configuration and spacing that was chosen years ago when this connector was first designed. This standard insert includes a cylindrical metal shell with the conductive pins or sockets attached at one end of the shell and fixed in place by a molded elastomer. However, no sealing devices are included at the opposite end of this connector.

The Syntrak 37-pin insert is installed on a wide range of seismic cables and streamers used in the industry. The various types of cables and streamers which must be connected to this industry standard insert have varying numbers and arrangements or configurations of electrical power, data, or telemetry conductors. The number or configuration of the conductors in these cables usually do not match the standard insert. For example, ten of the pins or sockets on the 37-pin insert are preallocated to power. Depending on the wire gauge of its power conductors, a connecting cable may have two, four, ten, or twelve insulated power conductors that must be connected to these ten pins or sockets on the Syntrak insert. If, for example, the connecting cable has two power conductors, each of these conductors must be transitioned into five separate, smaller diameter conductors for connection to a respective five of the ten pins or sockets allocated to power on the Syntrak insert. This transition has heretofore been accomplished by splicing the smaller diameter wires to the larger diameter conductor. It is very difficult to seal a spliced transition between conductors from water leakage, especially where the spliced connection is exposed to flexing and contact with sea water. In addition, the contact interface within the body of the insert must be sealed from the environment. A spliced cable transition to a standard insert therefore presents two potential sources of water leakage and resulting failure: in the conductor splicing, and in the contact interface.

Various methods have been used in an attempt to seal presently used connector inserts. Sealing is commonly achieved at the rear of inserts by means of heat shrink, potting techniques, elastomeric boots, or combinations of these techniques. Each of these methods has problems. For example, heat shrinks and boots often leak if a conductor is flexed. Potting techniques are highly dependent on process control and the ability of the resins to adhere for:extended periods of time to various conductor insulation materials and grades. Since cables typically contain various insulation materials, the latter problem is not insignificant. Cables containing polyethylene insulation present particular sealing problems due to difficulties in adhering sealant to the polyethylene.

Consequently, a need exists for an improved electric cable insert that will mate with industry standard inserts, provide a reliable, high integrity seal from the environment, and accommodate most cable insulation materials. Preferably, such a cable insert will be capable of easy and quick assembly to a cable without soldering. Ideally, such an insert can be assembled and disassembled in the field.

SUMMARY OF THE INVENTION

The present invention provides an electric cable insert designed to satisfy the aforementioned needs. According to one aspect of the invention, an electric cable insert is provided for removably electrically connecting a cable having multiple conductors to a mating receptacle having a plurality of sockets. The insert comprises a plurality of electrically conductive pins for connecting to respective sockets in the mating receptacle. The insert further includes a sealing gland having a plurality of bores therethrough, each of the cable conductors passing through a respective one of the bores in the sealing gland. Also included in the insert is means for electrically connecting the cable conductors to respective pins, and means for compressing the sealing gland so as to seal the insert from the environment.

According to an alternative embodiment of the invention, an electric cable insert is provided for removably electrically connecting a cable having multiple conductors to a mating receptacle having a plurality of projecting pins. The insert comprises a plurality of receiving sockets for receiving respective pins on the mating receptacle. The insert further includes a sealing gland having a plurality of bores therethrough, each of the cable conductors passing through a respective one of the bores in the sealing gland. Also included in this embodiment of the insert is means for electrically connecting the cable conductors to the respective receiving sockets, and means for compressing the sealing gland so as to seal the insert from the environment.

According to another alternative embodiment of the invention, an electric cable insert is provided for removably electrically connecting a cable having multiple conductors to a mating receptacle having a plurality of sockets, the number and configuration of the cable conductors being different from those of the sockets of the mating receptacle. The insert of this embodiment comprises a plurality of spaced receptacle pins for connecting to respective sockets in the mating receptacle, the number and configuration of the receptacle pins matching those of the receptacle. The insert also includes a sealing gland having a plurality of bores therethrough, the number and configuration of the bores matching those of the cable conductors. Each of the cable conductors passes through a respective one of the bores in the sealing gland. Also included in this embodiment of the insert is means, for conductively transitioning from the number and configuration of the cable conductors to the number and configuration of the sockets of the mating receptacle, and means for compressing the sealing gland so as to seal the insert from the environment.

According to still another alternative embodiment of the invention, an electric cable insert is provided for removably electrically connecting a cable having multiple conductors to a mating receptacle. The insert comprises a housing having two opposite ends and an internal cavity. The first end of the housing is open to the cavity and the second end has a plurality of orifices therethrough. A seal is disposed within the housing. The seal has two opposite sides and a plurality of tubes projecting from one side thereof, the tube bores extending through to the opposite side of the seal. Each of the tubes mates with a respective orifice in the second end of the housing. A contact header is disposed within the housing adjacent the seal. The header has first and second sides. A plurality of electrically conductive pins extend through the header. Each pin has a first end projecting from the first side of the header and through a respective one of the seal tube bores for electrically connecting to the mating receptacle, and a second end projecting from the second side of the header. A seating gland is disposed within the housing adjacent the contact header. The gland has a plurality of bores therethrough. A driver compressively engages the gland so as to seal the insert from the environment. The driver has a plurality of bores therethrough. Each of the conductors of the cable passes through a respective one of the bores in the driver and in the sealing gland and electrically connects to the second end of one of the pins.

According to another alternative embodiment of the invention, an electric cable insert is provided for removably electrically connecting a cable having multiple conductors to a mating receptacle having a plurality of projecting pins. The insert comprises a housing having two opposite ends and an internal cavity. The first end of the housing is open to the cavity and the second end has a plurality of orifices therethrough. A contact header is disposed within the housing adjacent the second end thereof. The header has first and second sides. The insert includes a plurality of spaced receiving sockets for receiving respective pins on the mating receptacle. Each receiving socket projects from the first side of the contact header. The receiving sockets pass through the contact header and have pins projecting from the second side of the contact header for connection to respective cable conductors. A sealing gland is disposed within the housing adjacent the contact header. The gland has a plurality of bores therethrough. A driver compressively engages the gland so as to seal the insert from the environment. The driver also has a plurality of bores therethrough. Each of the cable conductors passes through a respective one of the bores in the driver and in the sealing gland and electrically connects to one of the receiving socket pins.

According to still further alternative embodiment of the invention, an electric cable insert is provided for removably electrically connecting a cable having multiple conductors to a mating receptacle having a plurality of sockets. The number and configuration of the cable conductors is different from those of the sockets of the mating receptacle. The insert comprises a housing having two opposite ends and an internal cavity. The first end of the housing is open to the cavity, and the second end has a plurality of orifices therethrough. A seal is disposed within the housing. The seal has two opposite sides and a plurality of tubes project from one side thereof. The tube bores extend through to the opposite side of the seal. Each of the tubes mate with a respective orifice in the second end of the housing. A circuit card is provided for conductively transitioning from the number and configuration of the cable conductors to the number and configuration of the sockets of the mating receptacle. The circuit card has a first side and a second side. A plurality of spaced receptacle pins are attached to and extend from the first side of the circuit card and through respective orifices in the second end of the housing for connecting to respective sockets in the mating receptacle. The number and configuration of the receptacle pins match those of the receptacle sockets. A plurality of spaced contact pins are attached to and extend from the second side of the circuit card. The number and configuration of the contact pins match those of the cable conductors. A sealing gland is disposed within the housing adjacent the circuit card. The sealing gland has a plurality of bores therethrough. The number and configuration of the bores match those of the cable conductors. A driver compressively engages the gland so as to seal the insert from the environment. The driver has a plurality of bores therethrough. Each of the conductors of the cable passes through a respective one of the bores in the driver and in the sealing gland and connects to one of the contact pins extending from the circuit card.

BRIEF DESCRIPTION OF THE DRAWINGS

For a more complete understanding of the present invention, and the advantages thereof, reference is now made to the following Detailed Description of Example Embodiments of the Invention taken in conjunction with the accompanying drawings, in which.

DETAILED DESCRIPTION OF EXAMPLE EMBODIMENTS OF THE INVENTION

Figure 1:
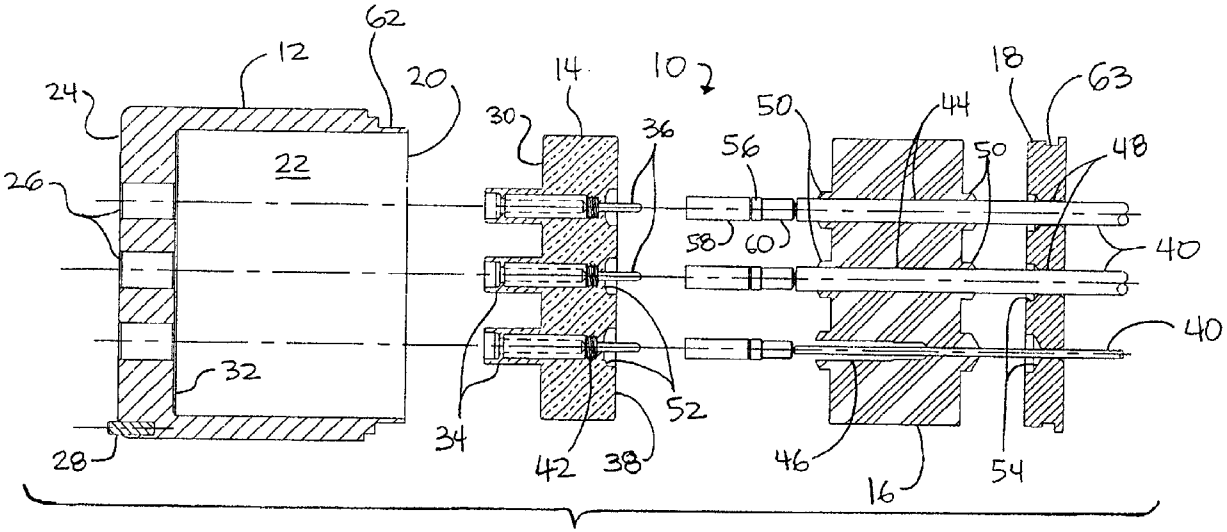
FIG. 1 is an exploded, cross-sectional view of a female cable insert of the present invention.

Example embodiments of the present invention and its advantages are best understood by referring to the drawings, like numerals being used for like and corresponding parts of the various drawings.

In FIG. 1, an example embodiment of a female electric cable insert of the invention is shown in exploded, cross-sectional view. The female insert, generally designated 10, includes housing 12, contact header 14, sealing gland 16, and driver 18. Housing 12 has a first end 20 open to an internal cavity 22, and a second end 24 having a plurality of orifices 26 therethrough. Orifices 26 in housing 12 correspond in number and spacing configuration to the projecting pins on a mating receptacle (not shown) to which insert 10 connects. Housing 12 is preferably made of steel or rigid plastic material. Orientation key 28 is attached to or formed on the periphery of housing 12 for orienting insert 10 with respect to the mating receptacle when connecting them together.

When assembled, contact header 14 is disposed within cavity 22 of housing 12. The first side 30 of contact header 14 abuts the inner wall 32 of housing 12. A plurality of spaced receiving sockets 34 project from the first side 30 of contact header 14 for receiving respective pins on the mating receptacle. Receiving sockets 34 extend through contact header 14. Pins 36 on receiving sockets 34 project out from second side 38 of contact header 14 for connection to respective cable conductors 40. Threads 42 on receiving sockets 34 secure sockets 34 in header 14. Contact header 14 is preferably made of rigid plastic, such as Fiberite Co. composition no. E2748, or of glass fired steel. Receiving sockets 34 and pins 36 are preferably made of steel.

Abutting contact header 14 within cavity 22 of housing 12 is sealing gland 16. A front view of an example embodiment of sealing gland 16 appears in FIG. 5. Cable conductors 40 pass through respective bores 44 extending through sealing gland 16. The bores 44 for the smaller diameter conductors 40 are counterbored 46 for ease of insertion and passage. Sealing gland 16 is preferably made of flurosilicone 70 duro A or other resilient, compressible material.

Abutting sealing gland 16 in insert 10 is driver 18, which compresses gland 16 within housing 12 so as to seal insert 10 from the environment. A front view of an example embodiment of driver 18 appears in FIG. 8. Cable conductors 40 pass through respective bores 48 extending through driver 18. Bores 48 in driver 18 are aligned with bores 44 in sealing gland 16 and with pins 36 on receiving sockets 34. Driver 18 is preferably made of alloy 360 brass, steel, or other rigid material.

Sealing gland 16 includes nipples 50 on its surface surrounding the opening to each of its bores 44. Nipples 50 mate to counterbores 52 in contact header 14 and to counterbores 54 in driver 18 for improved sealing of insert 10 when sealing gland 16 is compressed by driver 18.

Crimp/socket contacts 56 electrically connect cable conductors 40 to pins 36 of receiving An sockets 34. Each crimp/socket contact has a socket 58 on one end for connection to a receiving socket pin 36, and a deformable portion 60 on the opposite end for crimping to an end of a respective cable conductor 40. In an alternative embodiment, the ends of cable conductors 40 may be soldered to pins 36, in which case crimp/socket contacts 56 are not used.

Figure 2:
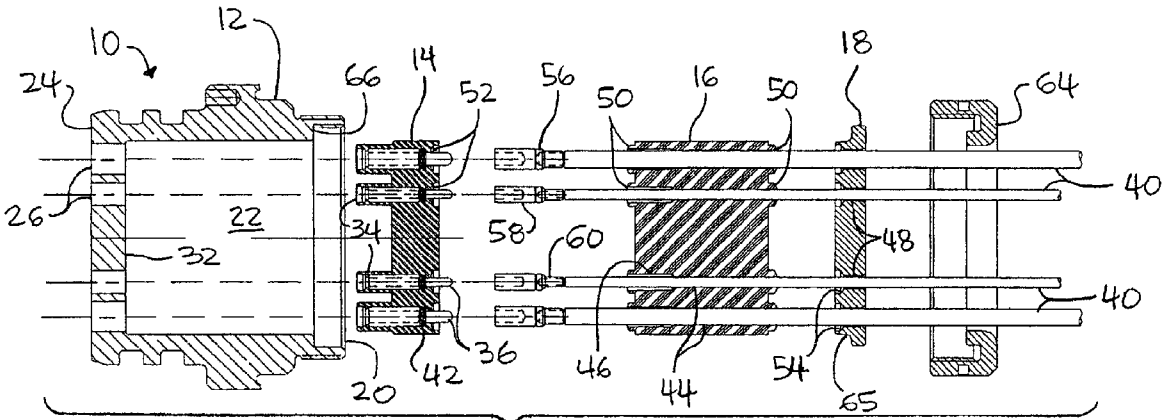
FIG. 2 is an exploded, cross-sectional view of an alternative embodiment of a female cable insert of the present invention.

Driver 18 is secured to housing 12 by a crimp in wall 62 of housing 12 pressed into retaining groove 63 in the circumferential surface of driver 18. Alternatively, driver 18 may be secured to housing 12 by a compression nut 64 threaded to the open end of housing 12, as seen in FIG. 2. In this case, driver 18 is provided with a flange 65 which abuts shoulder 66 in housing 12. Shoulder 66 limits the insertion travel of driver 18 as nut 64 is tightened, and thus prevents overcompression of sealing gland 16. Driver 18 is also provided with a key (not illustrated) that mates with a key slot in housing 12 for preventing rotation of driver 18 as compression nut 64 is tightened. The use of compression nut 64 to retain driver 18 in housing 12 is advantageous when disassembly of insert 10 is required for inspection or repair.

It will be apparent to those skilled in the art that there are many other ways in which driver 18 can be secured to housing 12, such as by the use of swage tangs, circlips, or adhesive, for some examples.

Female insert 10 is assembled to a cable as follows: First, the outer cable insulation is stripped away from the end portion of the connecting cable so that a short length of insulated conductors 40 are exposed. The free ends of conductors 40 are fed through respective bores 48 in driver 18 and bores 44 in sealing gland 16 as shown in FIG. 1. The insulation is then stripped from the ends of the individual conductors 40 and crimp/socket contacts 56 are crimped to the exposed wire ends. Sockets 58 of crimp/socket contacts 56 are then inserted over pins 36 of receiving sockets 34. Contact header 14, with conductors 40 now attached to receiving sockets 34, is fitted within bore 22 of housing 12 so that receiving sockets 34 extend through respective orifices 26 of housing 12. Driver 18 is then slid down conductors 40 and against sealing gland 16, and driver 18 and gland 16 are together slid further down conductors 40 and over crimp/socket contacts 56 until sealing gland 16 abuts contact header 14. Insert 10 is then placed in a press where force is applied to the exposed surface of driver 18 to compress sealing gland 16 within housing 12. When sealing gland 16 has been sufficiently compressed to seal the interior of insert 10 from the environment, wall 62 of housing 12 is crimped into groove 63 of driver 18 to secure driver 18 to housing 12 and to maintain the compression of sealing gland 16, thereby maintaining the seal of insert 10. The compressed sealing gland 16 creates an energized compression seal that compensates for movement of the cable conductors. As the depth of water in which the insert is used increases, the hydrostatic pressure on sealing gland 16 increases, thus providing additional compression and resistance to leakage at greater water depths.

Figure 3:
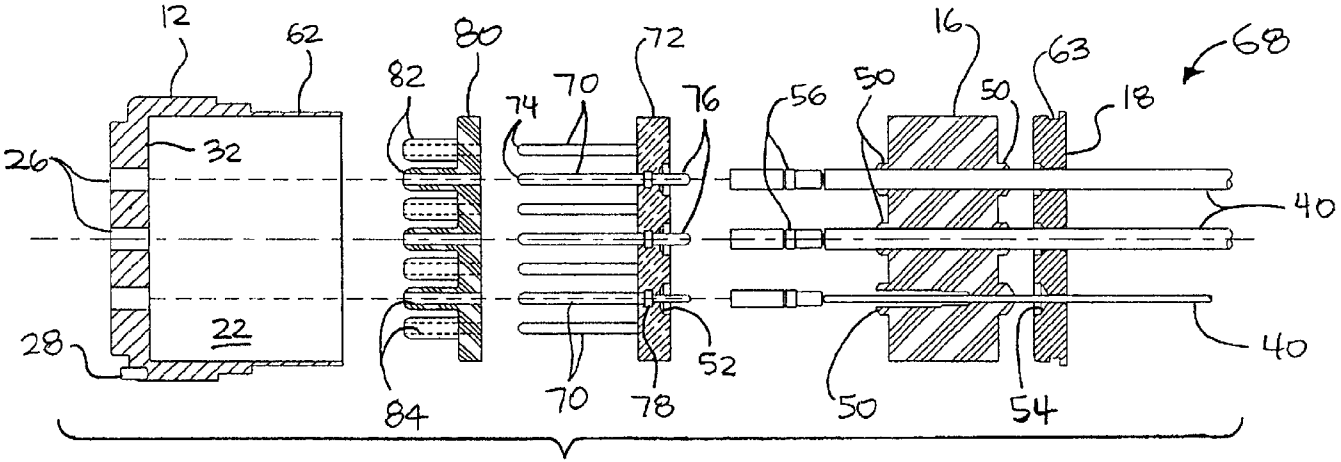
FIG. 3 is an exploded, cross-sectional view of a male cable insert of the present invention.

Referring now to FIG. 3, an example embodiment of a male cable insert of the invention is shown in exploded, cross-sectional view. The male insert, generally designated 68, is like female insert 10 of FIG. 1 in many respects; therefore only its differences from female insert 10 will be described in detail here.

Orifices 26 in housing 12 correspond in number and configuration to the pin receiving sockets on a mating receptacle (not shown) to which insert 68 connects. A plurality of spaced, electrically conductive pins 70 extend through contact header 72. First ends 74 of pins 70 project out from one side of contact header 72 for electrically connecting to respective sockets of the mating receptacle (not shown). Second ends 76 of pins 70 project out from the opposite side of header 72 for connecting to the respective cable conductors. Pins 70 also include circumferential shoulders 78 embedded in contact header 72 for securing pins 70 to header 72. Pins 70 are preferably made of steel.

Male insert 68 includes a seal 80 located between contact header 72 and inner wall 32 of housing 12. A plurality of tubes 82 project out from one side of seal 80. Bores 84 in tubes 82 extend through to the opposite side of seal 80. When assembled, pins 70 extend through respective tube bores 84, and seal tubes 82 extend through respective orifices 26 in housing 12. Seal 80 is preferably made of neoprene or other flexible elastomer. The sealing gland 16, driver 18, and crimp/socket contacts 56 of male insert 68 are essentially like those described earlier with respect to female insert 10.

Male insert 68 is assembled to a cable in a manner similar to that described above with respect to female insert 10, except that first ends 74 of pins 70 are inserted through bores 84 of seal 80 before contact header 70 is inserted into housing 12. When assembled, ends 74 of pins 70 and a portion of tubes 82 of seal 80 protrude out from orifices 26 of housing 12.

Figure 4:
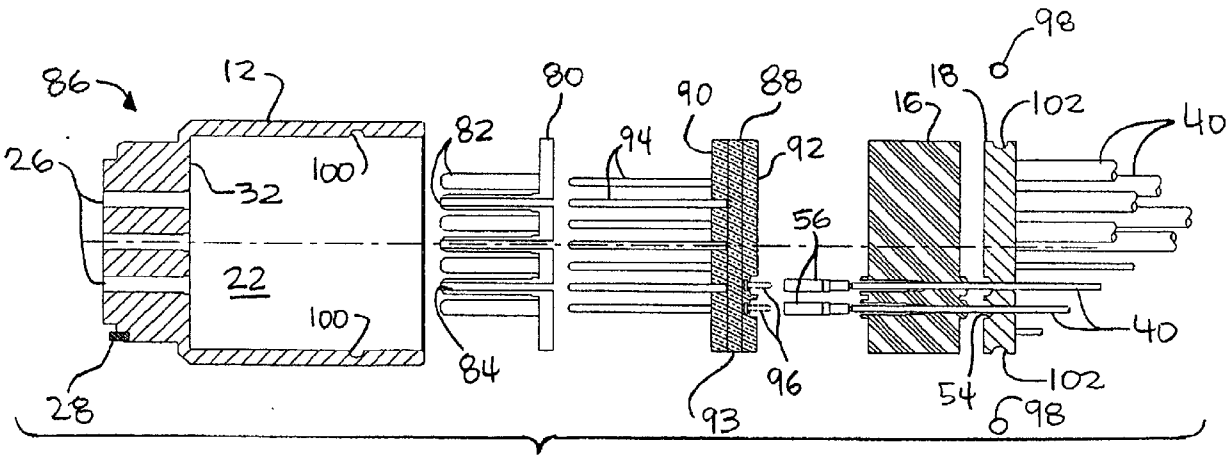
FIG. 4 is an exploded, cross-sectional view of a male transitioning insert of the present invention.

Referring now to FIG. 4, an example embodiment of a male transitioning insert is shown in exploded, cross-sectional view. The transitioning insert, generally designated 86, is like nontransitioning male insert 68 of FIG. 3 in many respects, therefore only its differences from male insert 68 will be described in detail here. Transitioning insert 86 is designed for use where the number and/or configuration of the cable conductors 40 in the cable to which an insert is to be installed is different from that of the sockets of the mating receptacle. In such a case, the number and/or configuration of the conductors must be transitioned within the insert from that of the cable to that of the mating receptacle. For example, the cable may have two power conductors that must each connect to five power sockets in the mating receptacle. In FIG. 4, the larger diameter conductors 40 carry power, and the smaller diameter conductors carry data or telemetry signals.

To accomplish the transitioning in number and/or configuration of the conductors, insert 86 includes a circuit card 88. Circuit card 88 comprises a pair of interconnected printed circuit boards 90 and 92 separated by an insulating layer 93. The manner of transitioning between numbers and layouts or configurations of electrical conductors by the use of multiple layered, interconnected circuit boards is well known to those skilled in the art of silk screened printed circuit boards.

A plurality of spaced receptacle pins 94 are attached to and project out from first circuit board 90 of circuit card 88 and through respective orifices 26 in housing 12 for connecting to respective sockets of the mating receptacle (not shown). The number and configuration of the receptacle pins 94 match those of the receptacle sockets. Similarly, a plurality of spaced contact pins 96 are attached to and project out from second circuit board 92 of circuit card 88 for connection to respective cable conductors 40, the number and configuration of the contact pins 96 matching those of the cable conductors 40. Receptacle pins 94 and contact pins 96 are preferably made of steel.

The seal 80, sealing gland 16, driver 18, and crimp/socket contacts 56 of transitioning insert 86 are essentially like those described earlier with respect to non-transitioning male insert 68 and FIG. 3. The sockets of crimp/socket contacts 56 attach to contact pins 96. In the embodiment illustrated in FIG. 4, driver 18 is secured to housing 12 by a pair of shear pins 98 inserted through orifices 100 in the wall of housing 12 and seated in a retaining groove 102 in the circumferential surface of driver 18. Transitioning insert 86 is assembled to a cable in a manner similar to that described above with respect to male insert 68, except that driver 18 is secured to housing 12 by shear pins 98 instead of by crimping the housing wall. It will be apparent that driver 18 can also be secured to housing 12 by crimping, as described above with respect to the non-transitioning cable inserts 10 and 68, or by the use of swage tangs, circlips, or adhesive, for some examples.

Figure 7:
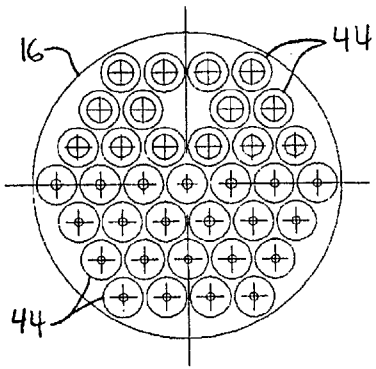
FIGS. 5, 6, and 7 are front, center cross-sectional, and rear views, respectively, of one example embodiment of a sealing gland of the present invention.
Figure 6:
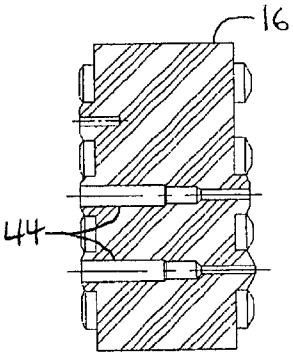
Figure 5:
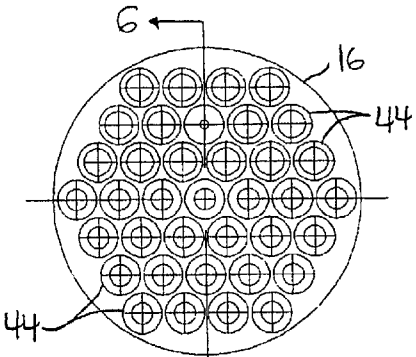
Figure 10:
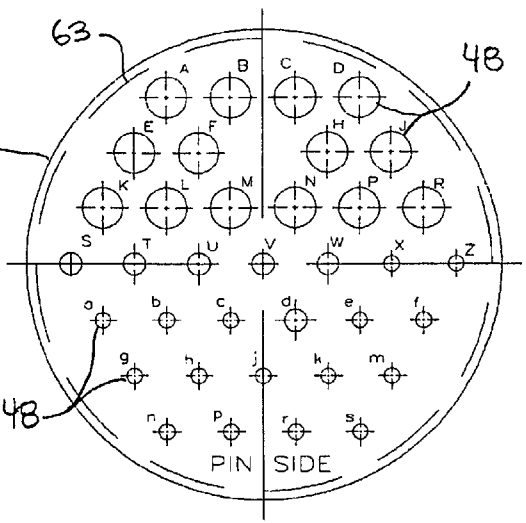
FIGS. 8, 9, and 10 are front, center cross-sectional, and rear views, respectfully, of one example embodiment of a driver of the present invention.
Figure 9:
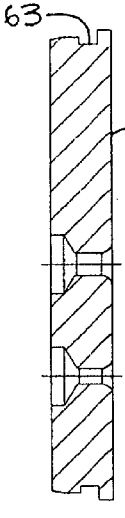
Figure 8:
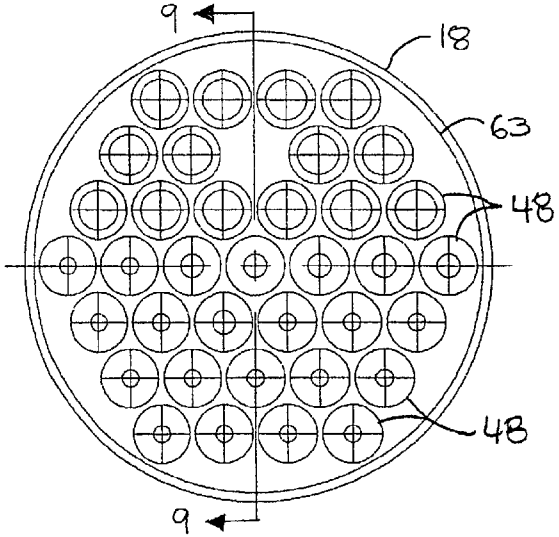

FIGS. 5, 6, and 7 are front, center cross-sectional, and rear views, respectively, of one example embodiment of sealing gland 16 that might be used with the cable insert of the present invention. In the illustrated embodiment, larger diameter bores 44 may receive power conductors, and smaller diameter bores 44 may receive data or telemetry conductors. FIGS. 8, 9, and 10 are front, center cross-sectional, and rear views, respectively, of a driver 18 corresponding to sealing gland 16 of FIGS. 5, 6, and 7. As with sealing gland 16, the larger diameter bores 48 of driver 18 may receive power conductors, and smaller diameter bores 48 may receive data or telemetry conductors.

There are several advantages obtained by the electric cable insert of the present invention. First, the insert provides its electrical interface with a highly reliable, entirely mechanical seal from the environment. Chemical bonds, which are less reliable than mechanical bonds, are avoided entirely in this insert. Second, the transitioning insert can be designed to mate a cable of any number and configuration of conductors to a standard receptacle having a different number and configuration of pins or sockets without any splicing of conductors. Third, the insert will accommodate polyethylene and other conductor insulations that are difficult to seal by other methods. Fourth, the insert can be easily and quickly assembled to a cable without any soldering. Finally, the insert can be assembled in the field with ordinary tools.

Although the cable insert of the present invention has been described here as it might be used in the offshore seismic exploration industry to connect streamers or lead-in cables, it should be recognized that the insert of this invention in its various embodiments can be used to connect many other types of electric cables in a wide variety of applications and industries.

The electric cable insert of the present invention, and many of its intended advantages, will be understood from the foregoing description of example embodiments, and it will be apparent that, although the invention and its advantages have been described in detail, various changes, substitutions, and alterations may be made in the manner, procedure, and details thereof without departing from the spirit and scope of the invention, as defined by the appended claims, or sacrificing all of its material advantages, the forms hereinbefore described being exemplary embodiments thereof.

What is claimed is:

1. An electric cable insert for removably electrically connecting a cable having multiple conductors to a mating receptacle having a plurality of projecting mating pins, the insert comprising:

a housing having an internal cavity therein;

a plurality of receiving sockets for receiving projecting mating pins on the mating receptacle, said receiving sockets including projecting socket pins thereon for connection to the respective cable conductors;

a sealing gland fitted within said cavity and having a plurality of bores therethrough, each of the cable conductors passing through a respective one of the bores in the sealing gland;

means for electrically connecting the cable conductors to the respective receiving sockets;

a contact header disposed within the housing for maintaining a spaced relationship between the receiving sockets, each of the receiving sockets passing through the contact header;

a driver secured to the housing for compressing the sealing gland against said contact header within the housing cavity so as to seal the insert from the environment; and wherein the sealing gland includes nipples on its surface surrounding the openings to each of the bores therethrough, and wherein the contact header and the drivers each have corresponding counterbores in their surfaces for receiving respective nipples on the sealing gland for improved sealing of the insert when the sealing gland is compressed.

2. The insert of claim 1, wherein the housing includes a side wall, the driver having a surface including a retaining groove therein, and wherein the driver is secured to the housing by a crimp in the side wall of the housing pressed into the retaining groove in the drive surface.

3. The insert of claim 1, wherein the housing has an end with a plurality of orifice therethrough for receiving respective projecting mating pins on the mating receptacle for insertion within the respective receiving sockets of the insert.

4. The insert of claim 1, wherein the means for electrically connecting the cable conductors to the respective receiving sockets comprises crimp/socket contacts having a contact socket on one end for sliding onto a receiving socket pin and a deformable portion on the opposite end for crimping to an end of the respective cable conductor.

5. The insert of claim 1, wherein the receiving sockets include threads engaging the contact header for securing the receiving sockets to the contact header.

6. An electrical cable insert for connecting a first plurality of electrical conductors included in a first cable to a respective second plurality of conductors included in a second cable, comprising:

a housing;

a sealing gland within said housing having a plurality of bores extending therethrough, each of the plurality of bores adapted for receiving a respective one of the first plurality of electrical conductors;

a plurality of pin and socket pairs within said housing for providing an electrical connection location between respective ones of said first plurality of conductors and respective ones of said second plurality of conductors;

a contact header disposed within the housing for maintaining a spaced relationship between said pin and socket pairs, each of the sockets of said pin and socket pairs passing through the contact header;

a driver secured to the housing for compressing said gland against said contact header to develop a sealing barrier around each of said first plurality of conductors and a sealing barrier around each said electrical connection location; and wherein the sealing gland includes nipples on its surface surrounding the openings to each of the bores therethrough, and wherein the contact header and the driver each have corresponding counterbores in their surfaces for receiving respective nipples on the sealing gland for improved sealing of the insert when the sealing gland is compressed.

* * * * *